US011621509B2

(12) United States Patent
Shen et al.

(10) Patent No.: US 11,621,509 B2
(45) Date of Patent: Apr. 4, 2023

(54) ELECTRIC CONNECTOR MODULE AND ELECTRIC CONNECTOR

(71) Applicant: DONGGUAN LUXSHARE TECHNOLOGIES CO., LTD, Dongguan (CN)

(72) Inventors: Xuehai Shen, Dongguan (CN); Rongzhe Guo, Dongguan (CN); Shengyu Wu, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 241 days.

(21) Appl. No.: 17/227,923

(22) Filed: Apr. 12, 2021

(65) Prior Publication Data

US 2021/0351526 A1 Nov. 11, 2021

(30) Foreign Application Priority Data

May 7, 2020 (CN) ..... 202020738761.8

(51) Int. Cl.
*H01R 24/00* (2011.01)
*H01R 12/70* (2011.01)
*H01R 13/514* (2006.01)

(52) U.S. Cl.
CPC ..... *H01R 12/7064* (2013.01); *H01R 13/514* (2013.01)

(58) Field of Classification Search
CPC ..... H01R 12/7011; H01R 12/7017; H01R 12/7023; H01R 12/7076; H01R 13/46; H01R 13/514
USPC ..... 439/660
See application file for complete search history.

(56) References Cited

U.S. PATENT DOCUMENTS

| | | | | |
|---|---|---|---|---|
| 10,910,760 | B1 * | 2/2021 | Yang | H01R 4/245 |
| 2023/0006381 | A1 * | 1/2023 | Li | H01R 12/716 |
| 2023/0006391 | A1 * | 1/2023 | Diessel | H01R 13/506 |

FOREIGN PATENT DOCUMENTS

| | | | |
|---|---|---|---|
| CN | 104466581 | B | 4/2017 |
| CN | 207977512 | U | 10/2018 |
| TW | M351521 | U | 2/2009 |

* cited by examiner

*Primary Examiner* — Khiem M Nguyen
(74) *Attorney, Agent, or Firm* — Birch, Stewart, Kolasch & Birch, LLP

(57) ABSTRACT

An electrical connector module includes an insulating body, a number of conductive terminals and a retaining piece. The insulating body includes an end wall. The end wall has an end surface and a protrusion. The retaining piece includes a main body and a mounting portion for being mounted to a circuit board. The main body includes a frame portion. The frame portion includes a mounting opening and a barb protruding into the mounting opening. The mounting opening is sleeved on the protrusion. The barb at least partially pierces into the protrusion for fixation. The present disclosure also discloses an electrical connector formed by combining a number of electrical connector modules.

16 Claims, 15 Drawing Sheets

ELECTRIC CONNECTOR MODULE AND ELECTRIC CONNECTOR

CROSS-REFERENCE TO RELATED APPLICATION

This patent application claims priority of a Chinese Patent Application No. 202020738761.8, filed on May 7, 2020 and titled "Electric connector module and electric connector", the entire content of which is incorporated herein by reference.

TECHNICAL FIELD

The present disclosure relates to an electrical connector module and an electrical connector, which belongs to a technical field of connectors.

BACKGROUND

In order to mount electrical connectors to circuit boards, some electrical connectors in the prior art are usually provided with retaining members which are fixed to insulating bodies, wherein the retaining members are provided with mounting feet for being mounted to the circuit boards. However, how to stably assemble the retaining member to the insulating body is a technical problem to be solved by those skilled in the art.

SUMMARY

An object of the present disclosure is to provide an electrical connector module capable of reliably assembling and fixing a retaining piece to an insulating body, and an electrical connector having at least two electrical connector modules.

In order to achieve the above object, the present disclosure adopts the following technical solution: an electrical connector module comprising: an insulating body comprising an end wall, the end wall comprising an end surface and a protrusion protruding from the end surface; a plurality of conductive terminals disposed in the insulating body; and a retaining piece assembled and fixed to the insulating body; wherein the retaining piece comprises a main body and a mounting portion for being mounted to a circuit board, the main body comprises a frame portion, and the frame portion comprises a mounting opening and at least one barb protruding into the mounting opening; and wherein the mounting opening is sleeved on the protrusion, and the barb at least partially pierces into the protrusion so as to be fixed to the protrusion.

In order to achieve the above object, the present disclosure adopts the following technical solution: an electrical connector comprising at least two electrical connector modules arranged side by side, each electrical connector module comprising an insulating body comprising an end wall, the end wall comprising an end surface and a protrusion protruding from the end surface; a plurality of conductive terminals disposed in the insulating body; and a retaining piece assembled and fixed to the insulating body; wherein the retaining piece comprises a main body and a mounting portion for being mounted to a circuit board, the main body comprises a frame portion, and the frame portion comprises a mounting opening and at least one barb protruding into the mounting opening; and wherein the mounting opening is sleeved on the protrusion, and the barb at least partially engages with the protrusion so as to be fixed with the protrusion; wherein the retaining pieces of two adjacent electrical connector modules are provided with bumps and grooves engaged with the bumps.

Compared with the prior art, the retaining piece of the present disclosure comprises a mounting opening so that it is convenient to sleeve on the protrusion. In addition, by providing at least one barb protruding into the mounting opening, after the mounting opening is sleeved on the protrusion, relative movement of the retaining piece and the insulating body makes it easy to pierce the barb into the protrusion for fixation, thereby improving the assembly reliability of the retaining piece.

DETAILED DESCRIPTION

Figure 1:
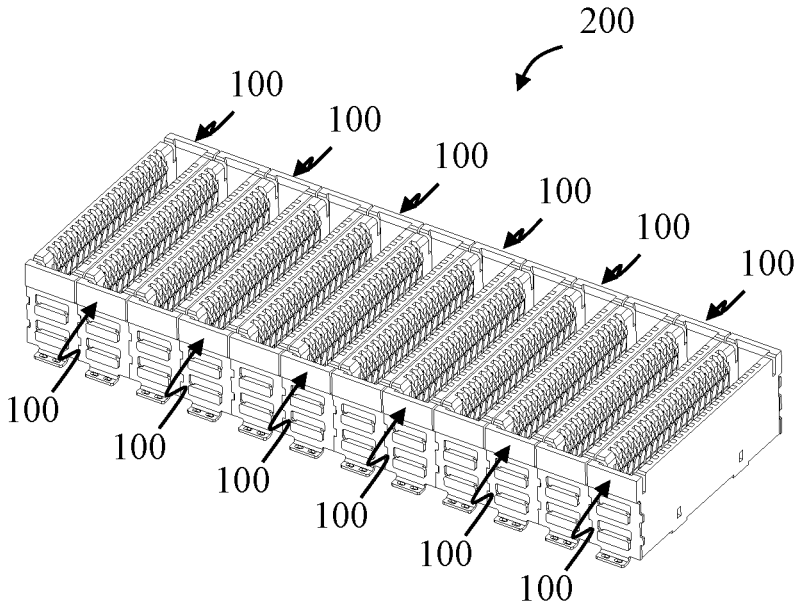
FIG. 1 is a schematic perspective view of an electrical connector in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
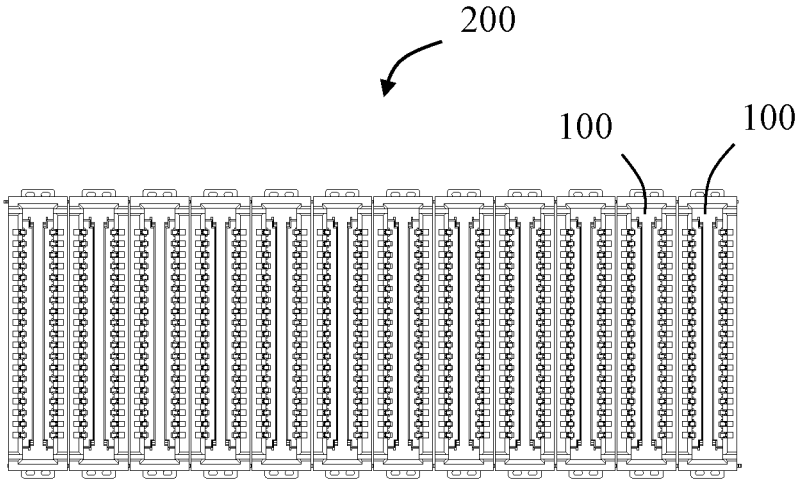
FIG. 2 is a front view of FIG. 1.
Figure 3:
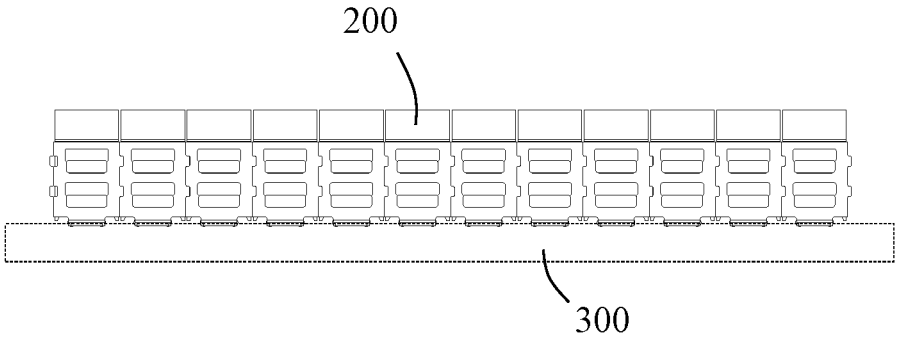
FIG. 3 is a side view of FIG. 1.

Referring to FIGS. 1 to 3, an embodiment of the present disclosure discloses an electrical connector 200 which is used to be mounted on a circuit board 300 for transmitting high-speed signals. In the illustrated embodiment of the present disclosure, the electrical connector 200 is formed by a plurality of electrical connector modules 100 with the same structure. The electrical connector modules 100 are arranged side by side along a left and right direction, and connected to each other.

Figure 4:
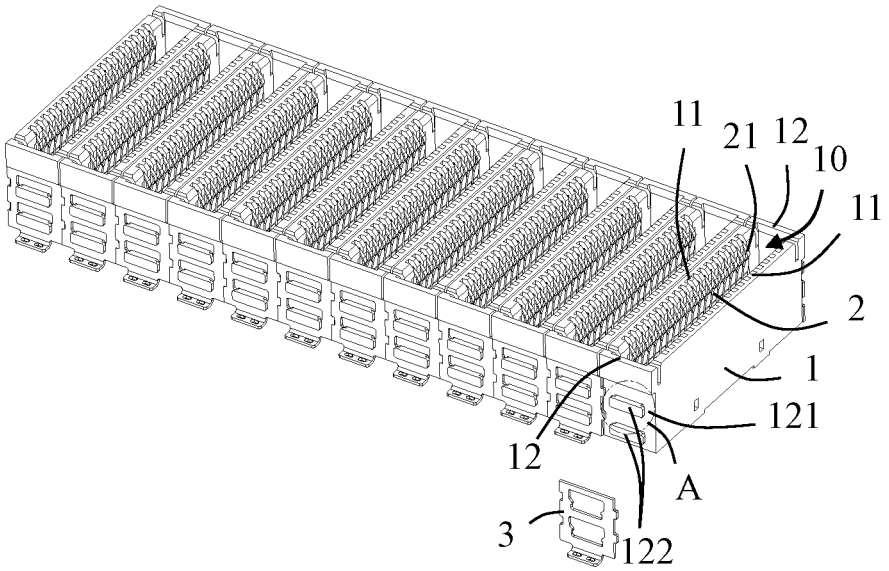
FIG. 4 is a partial exploded perspective view of FIG. 1, in which a retaining piece of the electrical connector module is separated.

Referring to FIG. 4, the electrical connector module 100 includes an insulating body 1, a plurality of conductive terminals 2 disposed in the insulating body 1, and at least one retaining piece 3 assembled and fixed to the insulating body 1.

The insulating body 1 includes two side walls 11 arranged oppositely, two end walls 12 connected to the two side walls 11 and located at both ends of the two side walls 11, and a receiving space 10 enclosed by the two side walls 11 and the two end walls 12. The receiving space 10 is adapted for receiving a mating connector (not shown).

Figure 10:
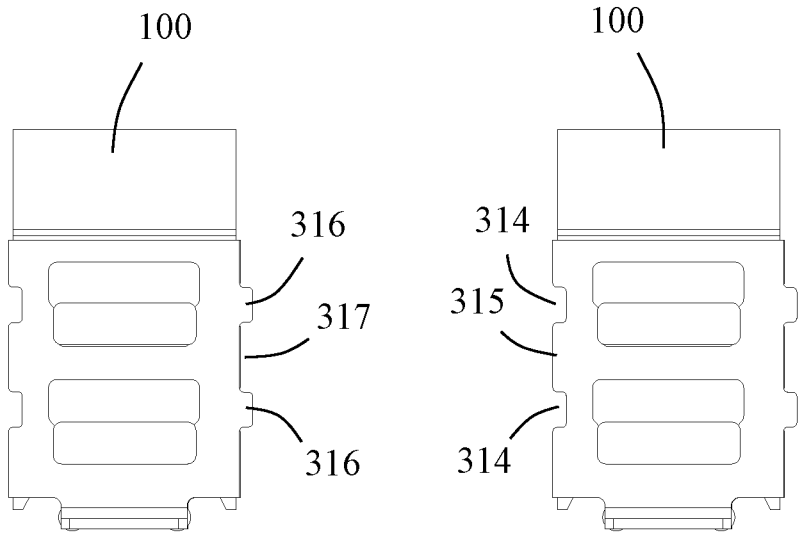
FIG. 10 is an exploded view of FIG. 9.
Figure 11:
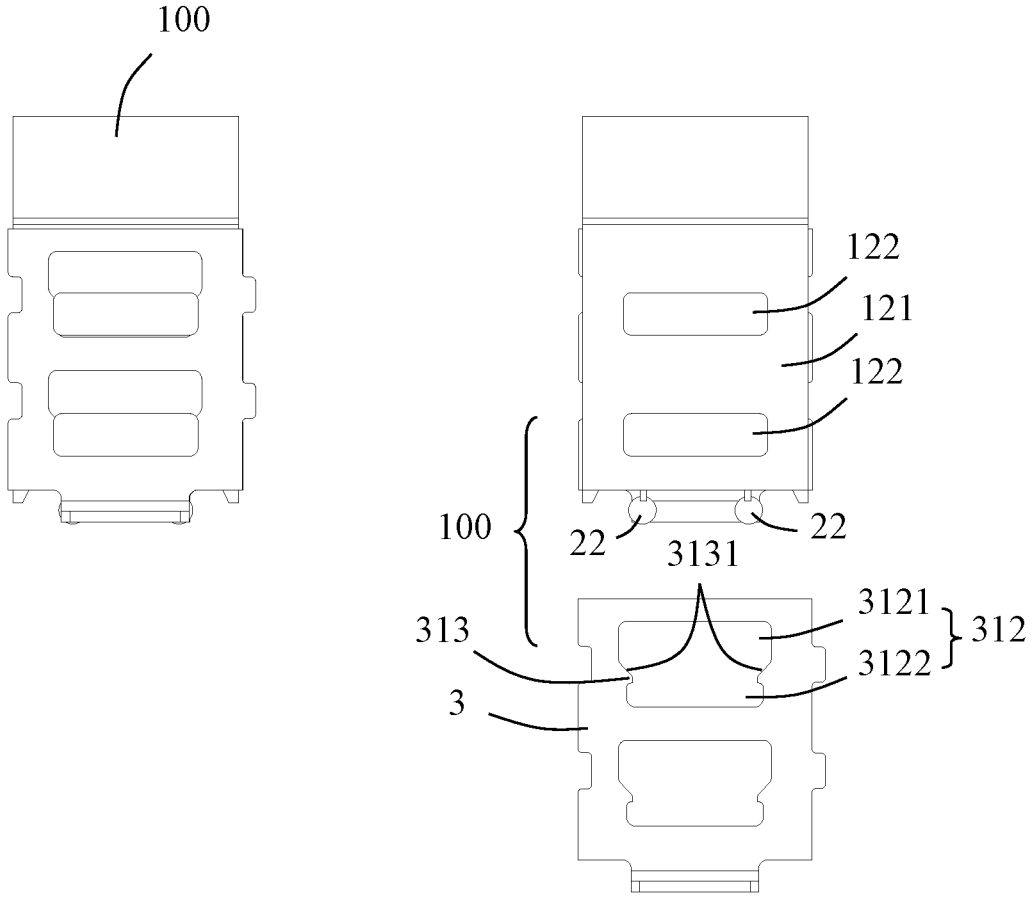
FIG. 11 is a further exploded view of FIG. 10, in which a retaining piece of the electrical connector module is separated.

The conductive terminals 2 are fixed to the two side walls 11 of the insulating body 1 by assembling or insert molding etc. Each conductive terminal 2 includes an elastic contact portion 21 protruding into the receiving space 10. In the illustrated embodiment of the present disclosure, the conductive terminals 2 are soldered to the circuit board 300 through solder balls 22 (referring to FIG. 10). Of course, in other embodiments, the conductive terminals 2 may also be electrically connected to the circuit board 300 via Through Hole or SMT.

Figure 5:
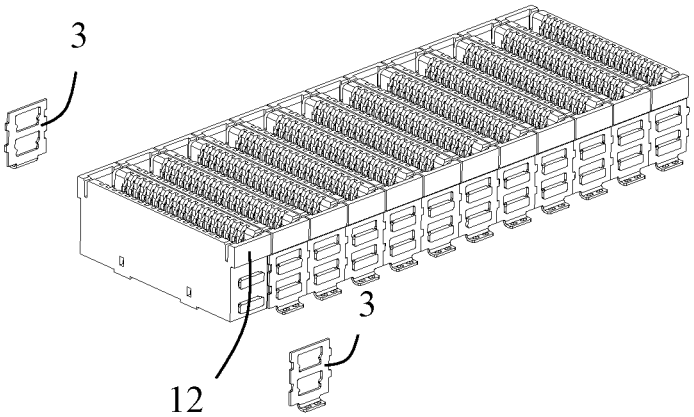
FIG. 5 is a further partial exploded perspective view of FIG. 4 from another angle, in which two retaining pieces of the electrical connector module are separated.

Referring to FIGS. 4 and 5, the two end walls 12 of the insulating body 1 are symmetrically arranged, and only one of the two end walls 12 will be taken as an example for detailed description.

Figure 6:
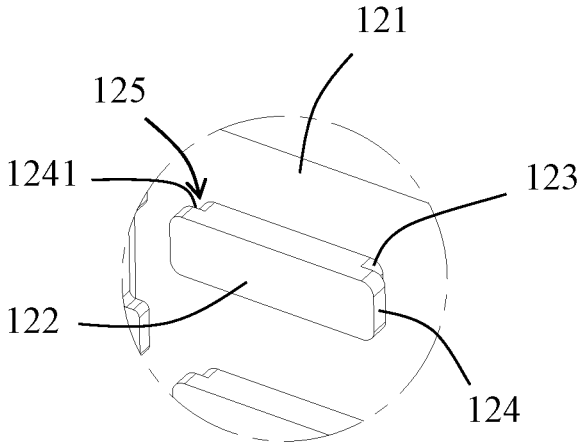
FIG. 6 is a partial enlarged view of a circled part A in FIG. 4.
Figure 7:
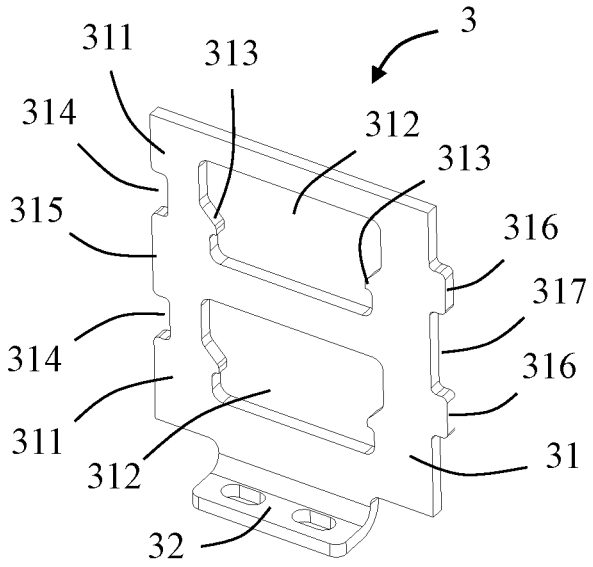
FIG. 7 is a schematic perspective view of the retaining piece in FIG. 4.
Figure 8:
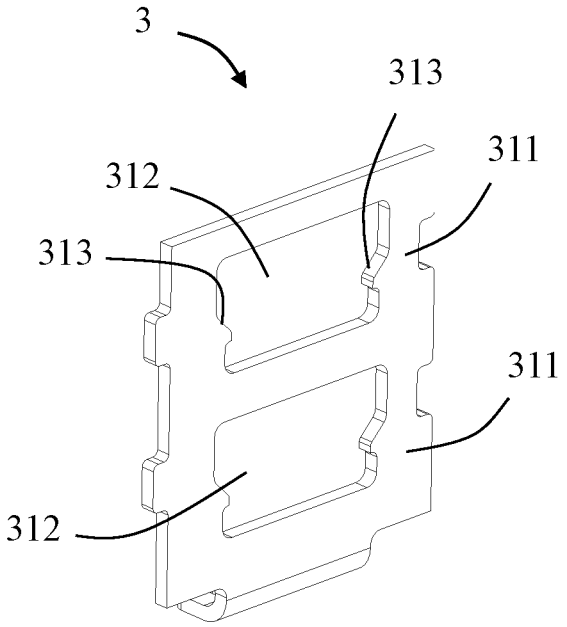
FIG. 8 is a schematic perspective view of FIG. 7 from another angle.
Figure 9:
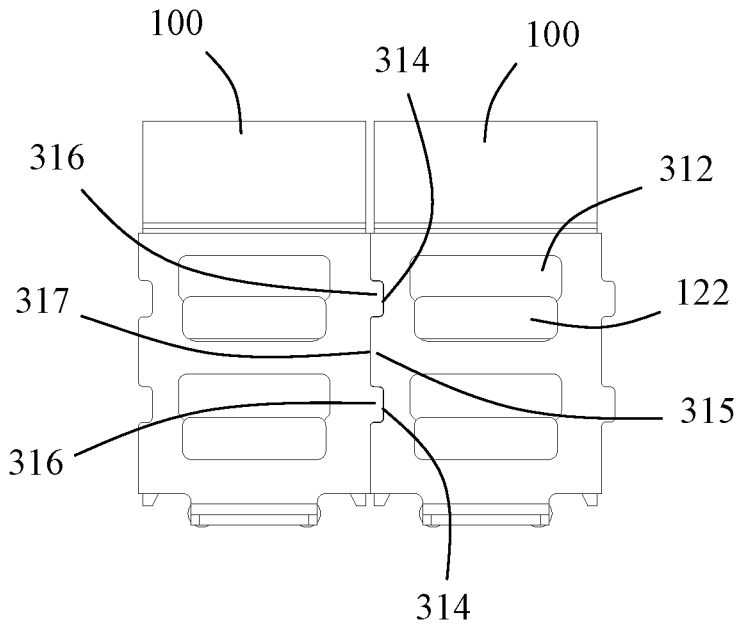
FIG. 9 is a side view of two electrical connector modules assembled together.
Figure 12:
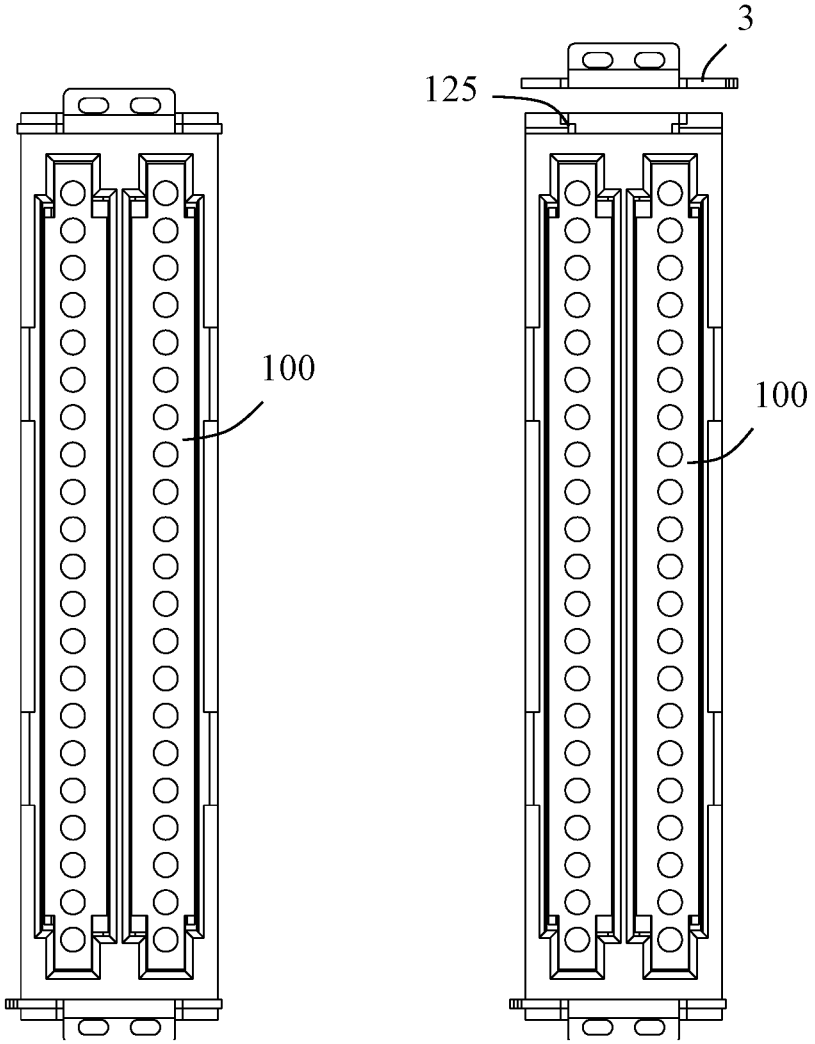
FIG. 12 is a bottom view of FIG. 11.
Figure 13:
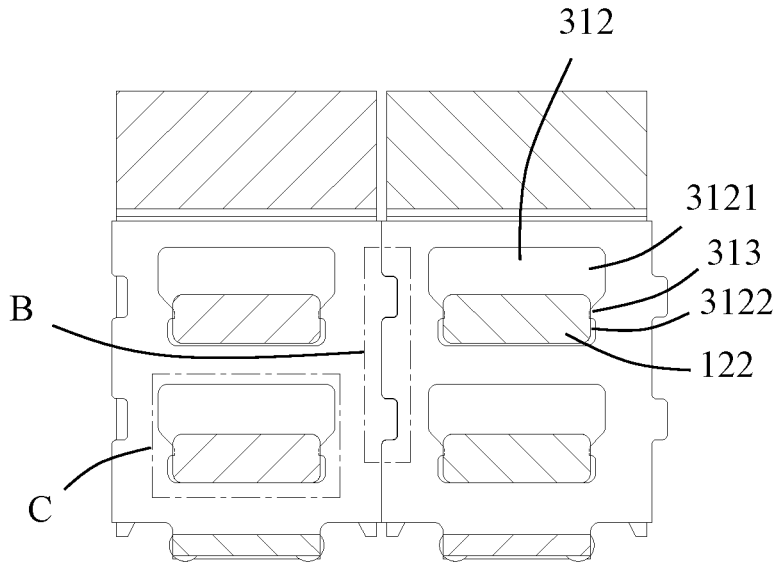
FIG. 13 is a schematic cross-sectional view of FIG. 9.

Referring to FIGS. 4, 6 and 12, the end wall 12 includes an end surface 121 and a protrusion 122 protruding from the end surface 121. In the illustrated embodiment of the present disclosure, the number of the protrusions 122 is two, and the two protrusions 122 are spaced apart from each other along an up and down direction. The structures of the two protrusions 122 are completely the same, and only one of the two protrusions 122 is used as an example for description.

The protrusion 122 includes a first connecting portion 123 connected to the end surface 121 and a second connecting portion 124 connected to the first connecting portion 123. The second connecting portion 124 has an inner surface 1241 facing the end surface 121. The protrusion 122 further includes a restriction groove 125 located between the end surface 121 and the inner surface 1241 for limiting the retaining piece 3 in a thickness direction of the retaining piece 3. A width of the first connecting portion 123 is smaller than a width of the second connecting portion 124. With this arrangement, the protrusion 122 has a wide outside and narrow inside structure, and the second connecting portion 124 can prevent the retaining piece 3 from detaching from the insulating body 1 outwardly.

Referring to FIGS. 7 to 15, the retaining piece 3 includes a main body 31 and a mounting portion 32 for being mounted to the circuit board 300. The main body 31 includes two frame portions 311 arranged vertically and spaced apart from each other. The two frame portions 311 have the same structure. Each frame portion 311 includes a mounting opening 312 and at least one barb 313 protruding into the mounting opening 312. The mounting opening 312 is sleeved on the protrusion 122. The barb 313 at least partially pierces into the protrusion 122 to be fixed to the protrusion 122. Each frame portion 311 also includes two first grooves 314 on one side and a first bump 315 between the first grooves 314, and two second protrusions 316 on the other side and a second groove 317 between the second protrusions 316.

Specifically, the mounting opening 312 includes a guiding groove 3121 and a mounting groove 3122 communicating with the guiding groove 3121. The barb 313 is located between the guiding groove 3121 and the mounting groove 3122. A width of the guiding groove 3121 is greater than a width of the mounting groove 3122, so as to facilitate the protrusion 122 to pass therethrough. The barbs 313 are located on both sides of the mounting opening 312 and pierce through the two side surfaces 1231 of the first connecting portion 123, respectively. Each barb 313 is provided with a guiding inclined surface 3131 exposed in the guiding groove 3121 in order to facilitate piercing the barb 313 into the first connecting portion 123.

When assembling the retaining piece 3, firstly, the mounting opening 312 with a larger width is set corresponding to the protrusion 122. Then, the protrusion 122 is passed through the mounting opening 312. Then, the retaining piece 3 and the protrusion 122 are moved relative to each other (for example, the retaining piece 3 is pushed upwardly). Under the guidance of the guiding inclined surface 3131, the barbs 313 pierce into the two side surfaces 1231 of the first connecting portion 123 (referring to FIG. 15). The first connecting portion 123 is at least partially engaged in the mounting groove 3122. The barb 313 is restricted by the restriction groove 125 in the thickness direction thereof. With this arrangement, the retaining piece 3 can be reliably mounted to the insulating housing 1, and the structural strength of the retaining piece 3 can be improved by providing the retaining piece 3 with a frame structure.

Figure 14:
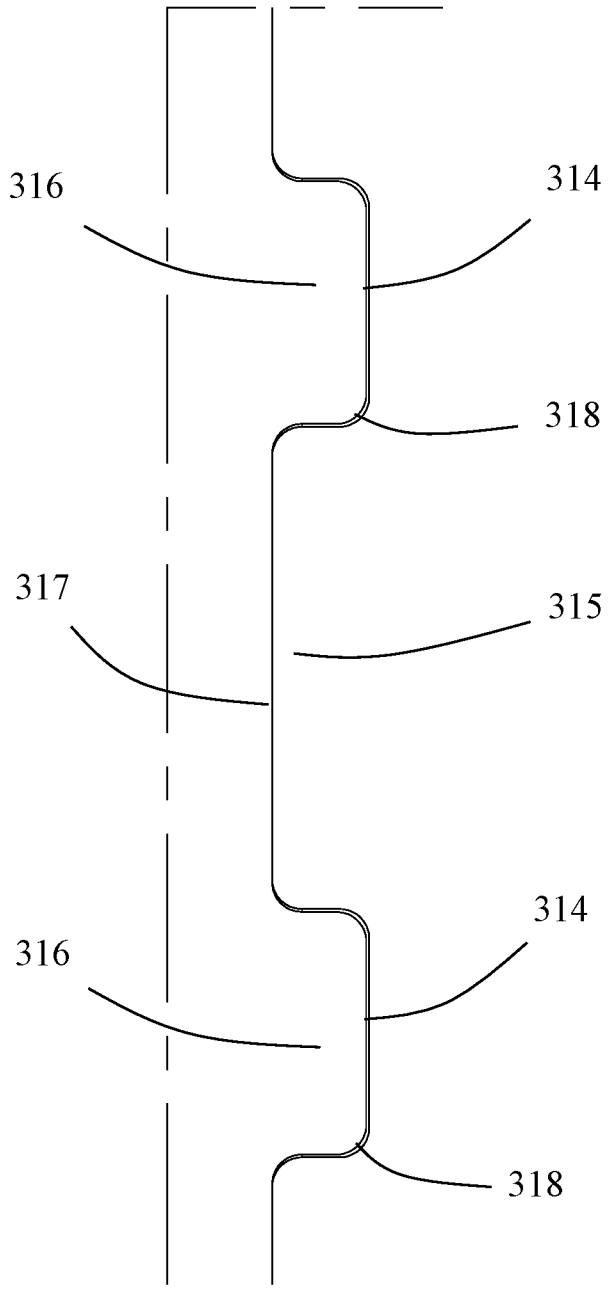
FIG. 14 is a partial enlarged view of a frame part B in FIG. 13.
Figure 15:
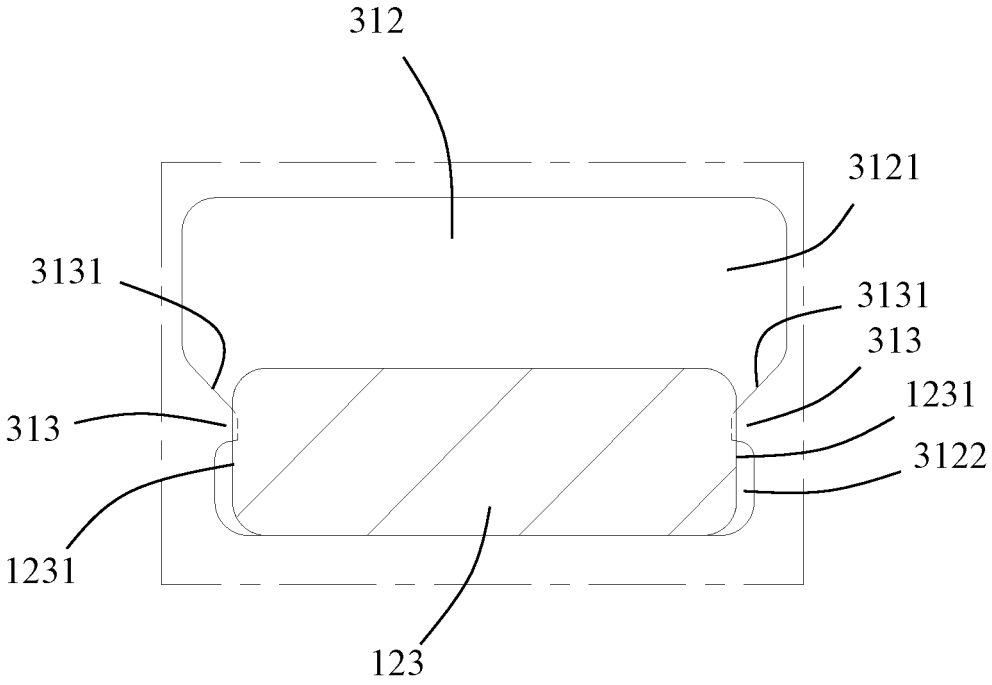
FIG. 15 is a partial enlarged view of a frame part C in FIG. 13.

Referring to FIG. 14, when a plurality of electrical connector modules 100 are arranged side by side to form the electrical connector 200, the first bump 315 of two adjacent electrical connector modules 100 is received in the corresponding second groove 317 of the two adjacent electrical connector modules 100. The second bumps 316 are received in the corresponding first grooves 314 of the two adjacent electrical connector modules 100. A Gap 318 is formed between the second bump 316 and the first grooves 314 in order to facilitate welding. For the same joint, the second bump 316 and the first bump 315 have different sizes, thereby improving the structural strength of a joint seam and making the joint seam be not easy to crack. Among them, the welding can be laser welding or tin soldering.

The above embodiments are only used to illustrate the present disclosure and not to limit the technical solutions described in the present disclosure. The understanding of this specification should be based on those skilled in the art.

Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector module, comprising:

an insulating body comprising an end wall, the end wall comprising an end surface and a protrusion protruding from the end surface;

a plurality of conductive terminals disposed in the insulating body; and a retaining piece assembled and fixed to the insulating body;

wherein the retaining piece comprises a main body and a mounting portion for being mounted to a circuit board, the main body comprises a frame portion, and the frame portion comprises a mounting opening and at least one barb protruding into the mounting opening; and wherein the mounting opening is sleeved on the protrusion, and the barb at least partially pierces into the protrusion so as to be fixed to the protrusion.

2. The electrical connector module according to claim 1, wherein the protrusion comprises a first connecting portion connected to the end surface and a second connecting portion connected to the first connecting portion, a width of the first connecting portion is smaller than a width of the second connecting portion, and the barbs are located on both sides of the mounting opening and pierce through two side surfaces of the first connecting portion, respectively.

3. The electrical connector module according to claim 2, wherein the second connecting portion comprises an inner surface facing the end surface, the protrusion comprises a restriction groove located between the end surface and the inner surface, and the barb is restricted by the restriction groove along a thickness direction of the barb.

4. The electrical connector module according to claim 2, wherein the mounting opening comprises a guiding groove and a mounting groove communicating with the guiding groove, the barb is located between the guiding groove and the mounting groove, a width of the guiding groove is greater than a width of the mounting groove, and the first connecting portion is at least partially engaged in the mounting groove.

5. The electrical connector module according to claim 4, wherein the barb comprises a guiding slope exposed in the guiding groove, so as to facilitate piercing the barb into the first connecting portion.

6. The electrical connector module according to claim 1, wherein the end wall comprises two protrusions spaced apart from each other along an up and down direction, and the main body comprises two frame portions spaced apart from each other along the up and down direction.

7. The electrical connector module according to claim 1, wherein the insulating body comprises two end walls opposite to each other, and the electrical connector module comprises two retaining pieces mated with the two end walls.

8. An electrical connector, comprising:

at least two electrical connector modules arranged side by side, each electrical connector module comprising:

an insulating body comprising an end wall, the end wall comprising an end surface and a protrusion protruding from the end surface;

a plurality of conductive terminals disposed in the insulating body; and a retaining piece assembled and fixed to the insulating body;

wherein the retaining piece comprises a main body and a mounting portion for being mounted to a circuit board, the main body comprises a frame portion, and the frame portion comprises a mounting opening and at least one barb protruding into the mounting opening; and wherein the mounting opening is sleeved on the protrusion, and the barb at least partially engages with the protrusion so as to be fixed with the protrusion;

wherein the retaining pieces of two adjacent electrical connector modules are provided with bumps and grooves engaged with the bumps.

9. The electrical connector according to claim 8, wherein the number of the bumps and the grooves are both greater than or equal to two, and at least two of the bumps have different diameters.

10. The electrical connector according to claim 8, wherein a gap is provided between the bump and the groove in order to facilitate welding.

11. The electrical connector according to claim 8, wherein the protrusion comprises a first connecting portion connected to the end surface and a second connecting portion connected to the first connecting portion, a width of the first connecting portion is smaller than a width of the second connecting portion, and the barbs are located on both sides of the mounting opening and pierce through two side surfaces of the first connecting portion, respectively.

12. The electrical connector according to claim 11, wherein the second connecting portion comprises an inner surface facing the end surface, the protrusion comprises a restriction groove located between the end surface and the inner surface, and the barb is restricted by the restriction groove along a thickness direction of the barb.

13. The electrical connector according to claim 11, wherein the mounting opening comprises a guiding groove and a mounting groove communicating with the guiding groove, the barb is located between the guiding groove and the mounting groove, a width of the guiding groove is greater than a width of the mounting groove, and the first connecting portion is at least partially engaged in the mounting groove.

14. The electrical connector according to claim 13, wherein the barb comprises a guiding slope exposed in the guiding groove, so as to facilitate piercing the barb into the first connecting portion.

15. The electrical connector according to claim 8, wherein the end wall comprises two protrusions spaced apart from each other along an up and down direction, and the main body comprises two frame portions spaced apart from each other along the up and down direction.

16. The electrical connector according to claim 8, wherein the insulating body comprises two end walls opposite to each other, and the electrical connector module comprises two retaining pieces mated with the two end walls.

* * * * *